US010030453B2

(12) United States Patent
Morrow

(10) Patent No.: US 10,030,453 B2
(45) Date of Patent: Jul. 24, 2018

(54) DEVICE FOR THE CONNECTION OF RODS FOR ROTATIONAL DRIVE OF A DOWNHOLE PUMPING APPARATUS

(71) Applicant: HARRIER TECHNOLOGIES, INC., Greenwich, CT (US)

(72) Inventor: William Bruce Morrow, Santa Barbara, CA (US)

(73) Assignee: HARRIER TECHNOLOGIES, INC., Greenwich, CT (US)

( * ) Notice: Subject to any disclaimer, the term of this patent is extended or adjusted under 35 U.S.C. 154(b) by 342 days.

(21) Appl. No.: 14/592,053

(22) Filed: Jan. 8, 2015

(65) Prior Publication Data

US 2016/0201404 A1 Jul. 14, 2016

Related U.S. Application Data

(60) Provisional application No. 62/078,033, filed on Nov. 11, 2014.

(51) Int. Cl.
*E21B 17/042* (2006.01)
*E21B 17/046* (2006.01)
*E21B 17/04* (2006.01)

(52) U.S. Cl.
CPC ..... *E21B 17/046* (2013.01); *E21B 17/04* (2013.01)

(58) Field of Classification Search
CPC ..... E21B 17/046; E21B 7/26
See application file for complete search history.

(56) References Cited

U.S. PATENT DOCUMENTS 6,439,618 B1 * 8/2002 Beeman ..... E21B 17/04 166/242.2
2011/0031020 A1 * 2/2011 Cote ..... E21B 4/10 175/56
2013/0101447 A1 * 4/2013 Brown ..... E21B 4/006 417/410.1

* cited by examiner

*Primary Examiner* — Giovanna C. Wright
*Assistant Examiner* — Brandon M Duck
(74) *Attorney, Agent, or Firm* — The Roy Gross Law Firm, LLC; Roy Gross

(57) ABSTRACT

A device for connecting sucker, or drive rods, consisting of a threaded coupling, one end of which has a right hand female thread and the other a left hand female, which joins the threaded pins of adjacent rods. The ends of the pins are equipped with dogs, or lugs, that interlock when the connection is made up, firmly linking the rods torsionally. The coupling serves only to keep the dogs, or lugs, engaged and to carry the tensional load on the connection. Such a connection provides a stronger torsional link between rods than connections currently available. The connection also does not require the special make-up procedure of the current systems and cannot over tighten or back off during operation.

20 Claims, 7 Drawing Sheets

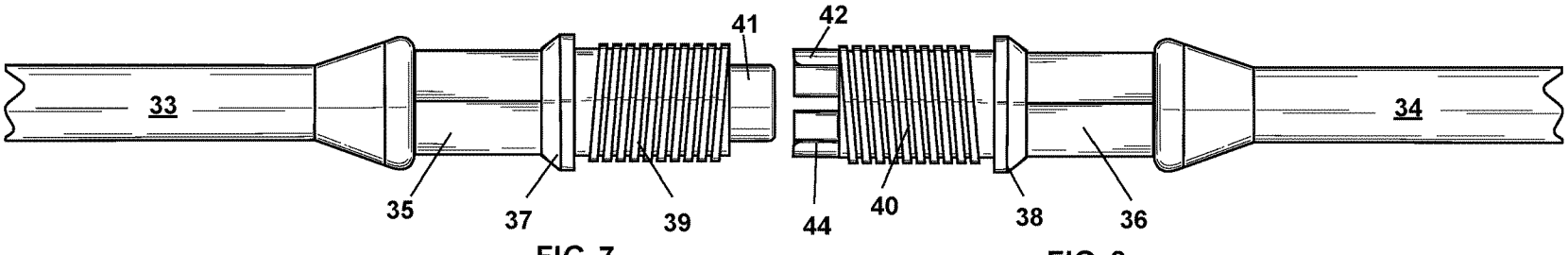
FIG. 8
FIG. 7
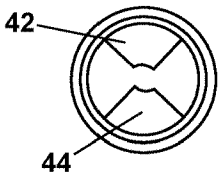
FIG. 10
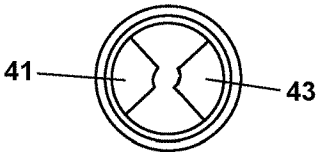
FIG. 9

DEVICE FOR THE CONNECTION OF RODS FOR ROTATIONAL DRIVE OF A DOWNHOLE PUMPING APPARATUS

Applicant claims the benefits of provisional application Ser. No. 62/078,033, filed Nov. 11, 2014. The present invention relates to improvements in connections between the individual segments of a rod string for the rotational drive of a downhole pump used in production wells to retrieve and deliver to the surface production fluids from subterranean deposits.

BACKGROUND OF INVENTION

Field of the Invention

A common method of lifting fluid from an oil well, the progressive cavity pumping system, utilizes a string of steel rods attached to a progressive cavity pump at the bottom of the well, that are rotated by a drive mechanism at the surface to activate the pump. This string of rods is similar to that used in a beam, or sucker rod, pumping apparatus, sharing an identical method of connection between the individual sections of rod, but utilizes rotational rather than reciprocating motion to activate the downhole pump.

The type of connection between rod segments utilized in both sucker rod pumping systems and progressive pumping systems (as well as other rod rotational drive pumping systems) consists of threaded pins at the ends of the rod segments, that are joined via an internally threaded female coupling. The threaded pins of the two rods to be joined are screwed into the female coupling until the machined ends of the coupling are tightly made up against machined shoulders on the rods. This type of connection was developed for the sucker rod application, where the rod motion is reciprocation, and loads on the rods and rod connections are entirely tensional.

When the progressive cavity pump was developed, the widely available sucker rods were utilized for the rotating rod string to drive the downhole pump, despite the fact that the sucker rod connection was not designed to transmit the torsional loads of the progressive cavity pump drive. The existing system of joining rods for rotational drive functions satisfactorily when installed and operated properly, but remains the single greatest problem of the various rotational rod drive systems. The present invention addresses these problems with a new rod connection system that is stronger and much easier to install properly than the existing system and will be only slightly, if at all, more costly than the existing system.

SUMMARY OF INVENTION

The existing system for joining the individual rods that make up the rod string used to rotationally drive a downhole pump consists of threaded pins at the ends of the rods connected via a female threaded coupling. The rods are equipped with machined shoulders near the threaded pins, and the rods are screwed into the coupling until the rod shoulders make up tightly against the ends of the coupling. The torsional force of one rod is transmitted to the adjacent rod through the coupling via the friction between the machined surfaces of the rod shoulders and the ends of the coupling.

The principal problem of the existing rod connection for rotating rod systems like the progressive cavity pumps, is over tightening of the connection during operation, resulting in failure of either the threaded pin or coupling. This over tightening occurs because of grease or dirt contamination lubricates the machined surfaces of the rod shoulders or coupling ends, allowing the connection to gradually tighten until either the pin or coupling fails. The surfaces of the rod shoulders and coupling ends must be absolutely clean, dry and free of any contamination, so that when the threaded connection is made up to the prescribed torque, the surfaces are "locked" in place by static friction. This cleanliness requirement is a significant burden during rod string installation, as making sure that every connected surface is completely clean, in the naturally oily and dirty environment of a well service rig, requires constant vigilance. There only needs to be one less-than-clean connection out of hundreds to result in a rod connection failure.

Another problem with the existing rod connection for rotating rod systems, is the threads of the connection are under both torsional and tensional loading, as the coupling must both transmit torsional load to the coupling, as well as carry the tensional loading due to rod weight. This problem is, at its worst, at or near the surface, as the tension on the rod pins is maximized due to the weight of the rods hanging below, and the rod pins can fail, particularly during start-up torque surges.

A further, but lesser, problem with the existing rod connection system is the backing-off separation of the rods. Since the existing connection consists typically of right-hand threaded members, back spinning of the rod string, which will occur with progressive cavity pumps whenever the surface drive is shut off, can result in the unscrewing of one or more of the connections, requiring a costly well service to reconnect the rods.

The present invention eliminates all of these problems with the existing rod connections by physically linking adjacent rods for torsional load transmission via a dog clutch, or similar connection between the rods, thereby removing the torsional loading of the threads and holding the rods end together via a right-left threaded coupling that cannot over-tighten nor back-off after make up.

DESCRIPTION OF THE DRAWINGS

FIG. 7 shows the end of a rod of the present invention, in position for connection to an adjacent rod, showing the left-hand threads and the side view of a dog clutch element;

FIG. 8 shows the end of the adjacent rod of the present invention in position for connection, showing the right-hand threads and the side view of the dog clutch elements;

FIG. 9 is an end view of the FIG. 7 rod, showing the position of the dog clutch elements;

FIG. 10 is an end view of the FIG. 8 rod, showing the position of the dog clutch elements oriented to mate with the dog clutch elements of FIG. 9.

DETAILED DESCRIPTION OF PREFERRED EMBODIMENT

To appreciate the benefits of the present invention compared to the existing rod connection method, the details and dynamics of the existing system should be examined.

Figure 1:
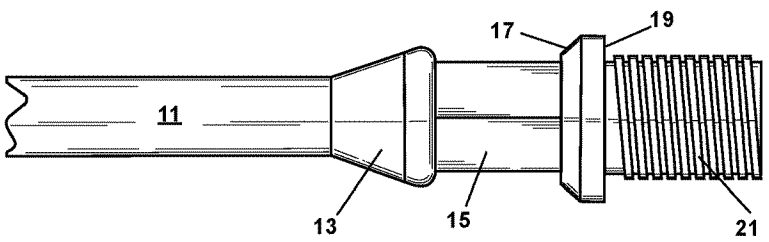
FIG. 1 (Prior Art)
FIG. 1 shows the threaded pin end of a conventional sucker, or drive rod, in position for an existing type connection to an adjacent rod.

The general configuration of the rod connection for both sucker rods and drive rods is shown in FIG. 1. At the end of the rod body 11 is the coupling assembly, consisting of the transition flare, 13, the wrench flat, 15, the rod shoulder, 17, with the machined surface 19 facing the threaded rod pin, 21. Note that the threads of the threaded rod pin are right-hand, as is the norm in the petroleum industry. The adjacent rod, shown as FIG. 2, has the same components of the coupling assembly, including right-hand threads on the threaded rod pin.

Figure 2:
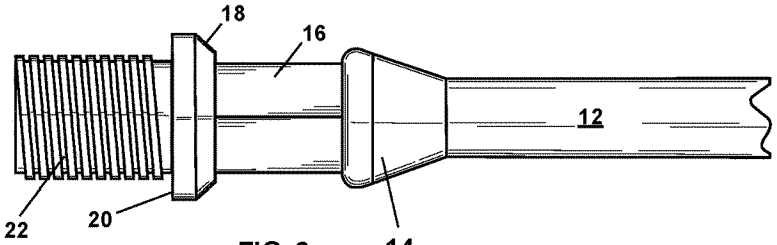
FIG. 2 (Prior Art)
FIG. 2 shows the threaded pin end of the adjacent sucker, or drive rod, in position for connection.
Figure 4:
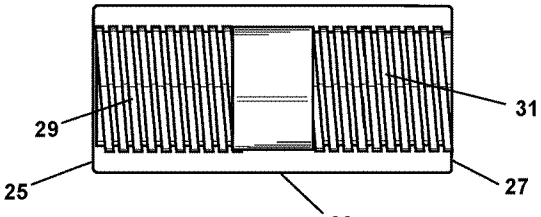
FIG. 4 (Prior Art)
FIG. 4 shows a semi transparent view of the FIG. 3 coupling, showing the internal female threads.
Figure 3:
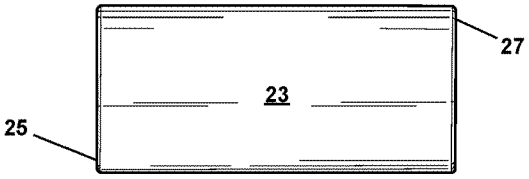
FIG. 3 (Prior Art)
FIG. 3 shows a side view of a female internally threaded coupling.

The two rods shown in FIG. 1 and FIG. 2 are joined via an internally threaded female coupling, 23, shown in side-view in FIG. 3. Both ends of the internally threaded coupling 23 are machined flat surfaces 25 and 27, and are designed to bear against the machined surfaces 19 and 20 of the rod shoulders 17 and 18. The internal threads of the internally threaded female coupling 23, shown as 29 and 31, are shown in FIG. 4. Note that both internal threads 29 and 31 are right-hand threads to mate with the right-hand threads of the threaded rod pins 21 and 22, respectively.

Figure 5:
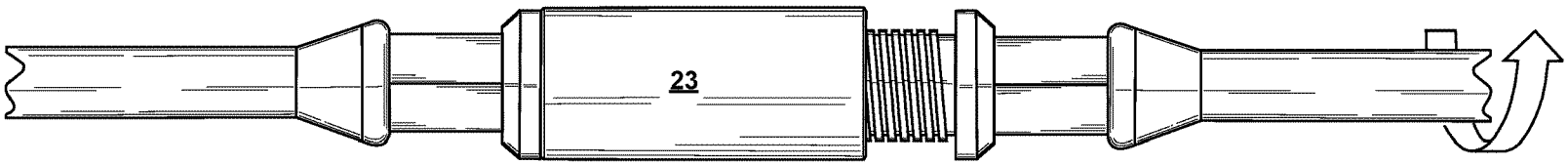
FIG. 5 (Prior Art)
FIG. 5 shows the FIGS. 1 and 2 rod ends partially connected via the FIG. 3 threaded coupling, where the coupling has been made up finger tight on the FIG. 1 threaded pin, and the FIG. 2 threaded pin is partially screwed into the coupling.
Figure 6:
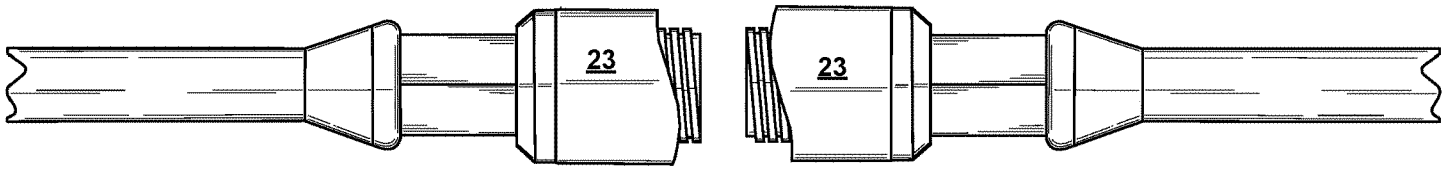
FIG. 6 (Prior Art)
FIG. 6 shows the connection between the FIG. 1 and FIG. 2 rods completely made up, with a cut-away through the coupling showing the relative position of the threaded pins.

The connection between the two rods is affected by first screwing internally threaded female coupling 23 on to the threaded rod pin 21 of FIG. 1 rod until hand-tight, then screwing the adjacent FIG. 2 rod into the internally threaded female coupling 23, as shown in FIG. 5. Once FIG. 2 rod is fully threaded into internally threaded female coupling 23, the two rods are then torqued to a desired value, and the connection is complete, as seen in FIG. 6. FIG. 6 also shows, via a cut-away of the internally threaded female coupling 23, the relative positions of the threaded rod pins 21 and 22 of the joined rods. Note that they are not in physical contact with one another.

As seen in FIG. 6, the threaded rod pins 21 and 22 are not in direct physical contact. The only connection between the rods for torque transmission is via the internally threaded female coupling, 23. Internally threaded female coupling 23 is not fixedly connected to either rod, or through another mechanical means like a spline or other toothed connection. The only effective torsional connection internally threaded female coupling 23 has with either rod is via the friction between the machined flat surface ends 25 and 27 of the internally threaded female coupling, and the machined surfaces 19 and 20 of the rod shoulders 17 and 18, respectively. This frictional connection is only effective if the aforesaid machined surfaces are completely clean and dry, so that the make-up of the connection results in a "locked" condition, held in place by static friction that is greater than what any expected torque could overcome.

Threaded connections, such as that shown in FIG. 6, with the aforesaid machined ends 25 and 27, and machined surfaces 19 and 20 that are less than perfectly clean and dry, are prone to gradually tighten during operation, and particularly due to torque surges during start-up, finally causing the pin threads to fail in sheer, or the pin body to fail in tension. Less than clean connections also could loosen and back off during back-spin when the system is shut-down. All of these attendant problems of the existing rod connection when used in a rotational drive system can be eliminated by utilizing the present invention.

The most serious problem of the existing system is that the rods are not physically connected for torsion, except via the friction between the internally threaded female coupling 23 and the rod shoulders 17 and 18. A better configuration would be to have a mechanical torsional connection between the rod ends. However, such a mechanical connection requires that the two rods cannot rotate freely relative to one another when connected, so utilizing the existing right hand threaded pin-coupling connection is not feasible. To make up such a connection, the two rods must rotate relative to one another, and if they are mechanically torsionally connected, this relative rotation is not possible. The present invention gets around this problem by utilizing a coupling with both right and left hand threads, which engages with the threaded rod pins 20 and 21 with similar right and left hand thread, rather like a turnbuckle, to draw the rods together in a fixed rotational position relative to one another, so that a mechanical torsional connection of some sort can be engaged as the rods are being pulled together.

Referring to FIGS. 7 and 8, the adjacent ends of two rods to be connected are shown. Both rods are similar to those shown in FIGS. 1 and 2, having, respectively, a rod body 33 and 34, wrench flat 35 and 36, shoulder 37 and 38 and a threaded rod pin 39 and 40. However, the FIG. 7 threaded rod pin 39 has a left-hand thread, as opposed to the right-hand thread of threaded rod pin 21. The FIG. 8 threaded rod pin 40 has a right-hand thread. Also, machined into the ends of both rods are the dogs of a two-lobe dog clutch assembly. The rod of FIG. 7 has dogs 41 and 43 (43 not visible in this view), and the rod of FIG. 8 has dogs 42 and 44. Each dog is a machined steel "lug", with the quarter circle cross-sectional shape, with each rod having two dogs 180° apart, as seen in the end views of the rod ends shown as FIGS. 9 and 10. The dogs 41 and 43 on the FIG. 7 rod, and the dogs 42 and 44 on the FIG. 8 rod are machined to interlock and engage snugly together, as seen in FIGS. 11 and 12, forming mechanical torsional connection between the rods that is significantly stronger than the torsional limit of the rod body 33 and 34.

Figure 11:
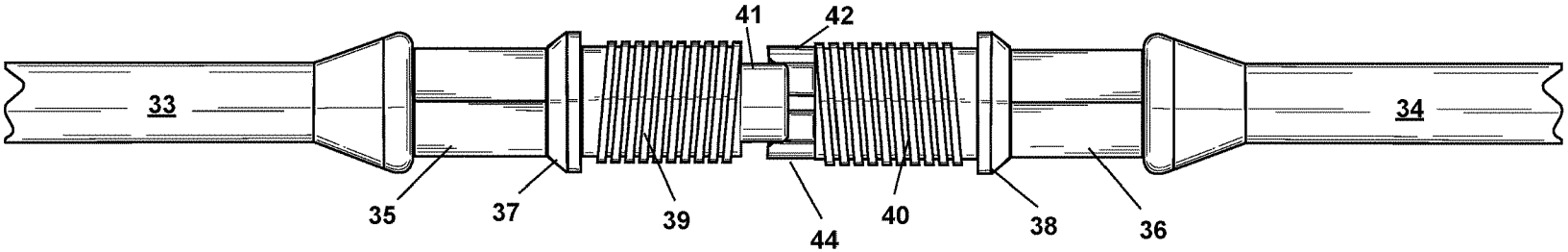
FIG. 11 shows the FIG. 7 and FIG. 8 rod ends of the present invention in partial engagement, with the FIG. 11 coupling not shown for clarity.
Figure 12:
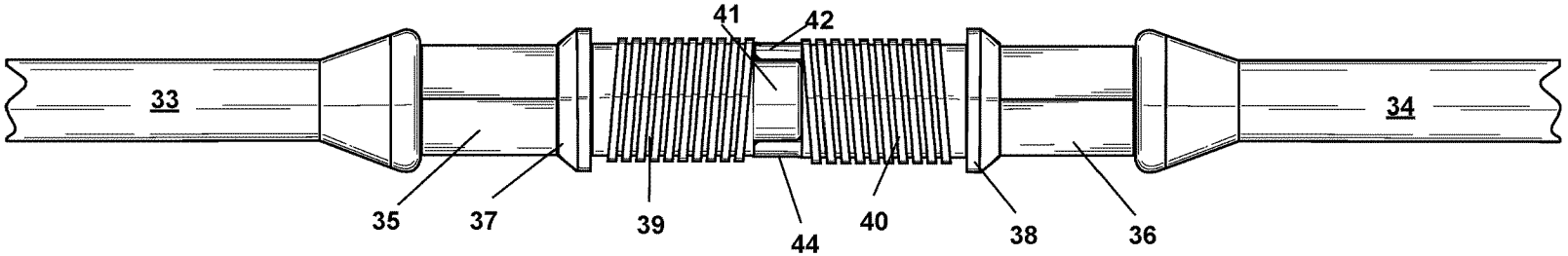
FIG. 12 shows the FIGS. 7 and 8 rod ends in complete engagement, with the coupling not shown for clarity.
Figure 13:
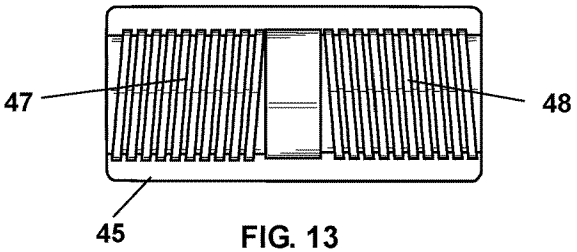
FIG. 13 is a semi-transparent side view of the threaded female coupling of the present invention, showing the internal threads of both right and left-hand sense.

FIGS. 11 and 12 show how the dogs engage, with the female coupling 45 holding them together, not shown for clarity. The female coupling 45 is shown in FIG. 13, with the semi-transparent view showing the left-hand internal threads 47 on the left, matching the left-hand threads 39 of the FIG. 7 threaded rod pin 40, and the right-hand internal threads 48 on the right, matching the right-hand threads of the FIG. 8 threaded rod pin 40.

Figure 14:
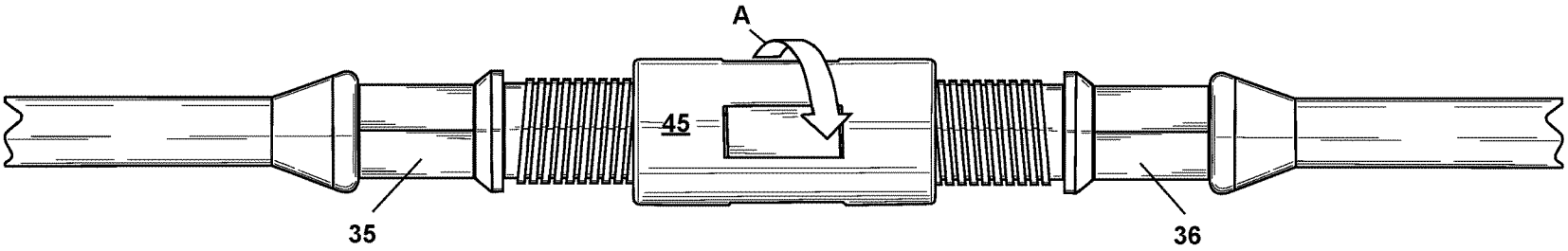
FIG. 14 shows the initial stage of the connection process of the present invention, showing the relative rotation of the FIG. 11 coupling as the rods of FIGS. 7 and 8 are pulled together by the reverse threaded coupling.
Figure 15:
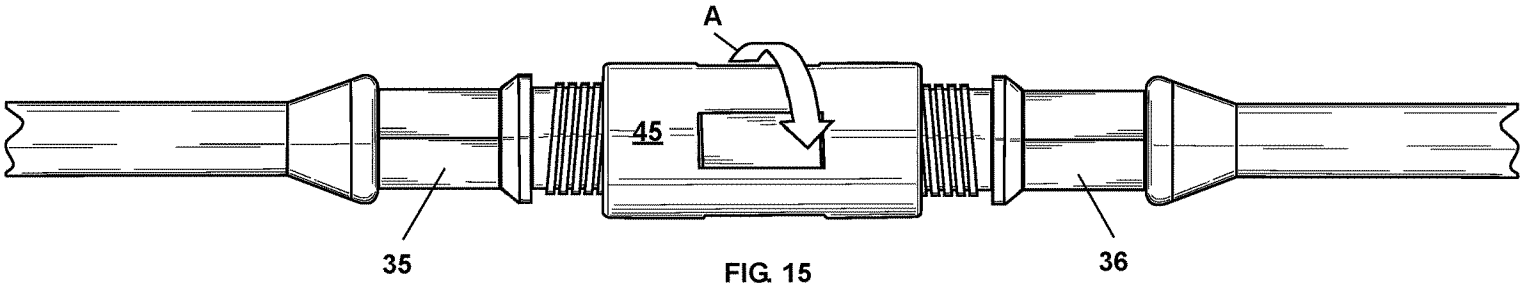
FIG. 15 shows the connection process of the present invention partially complete, showing the continued rotation of the coupling.
Figure 16:
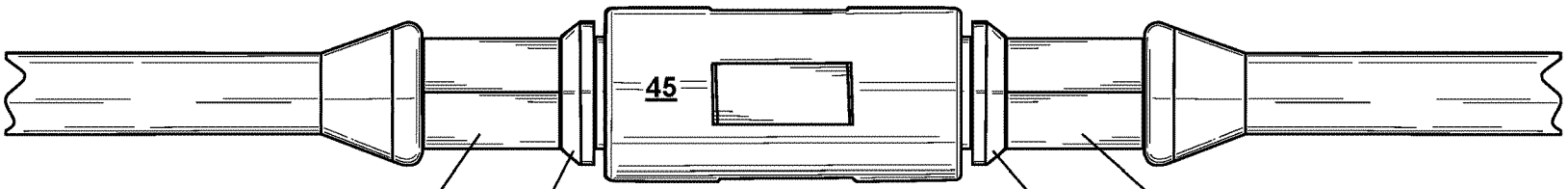
FIG. 16 shows the connection process of the present invention complete.
Figure 17:
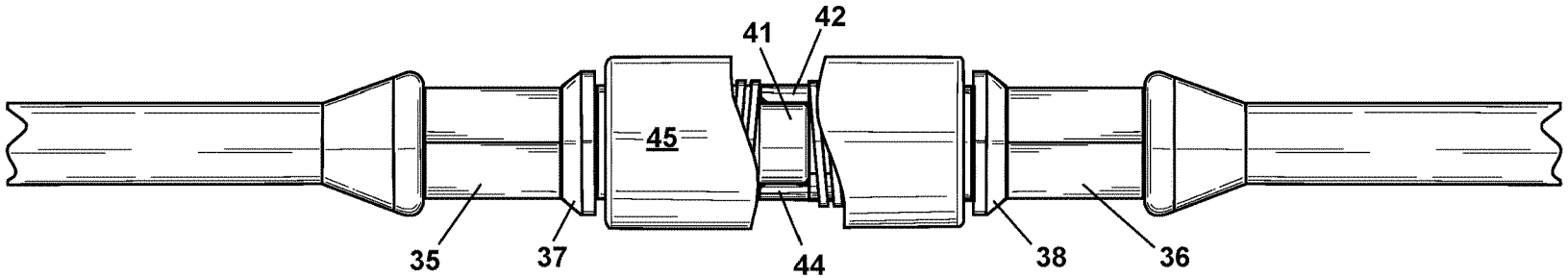
FIG. 17 shows the made-up connection of the present invention, with a cut-away through the coupling to show the dog clutch elements completely engaged, as in FIG. 13.

FIGS. 14, 15 and 16 show how the connection between the adjacent rods is made-up. The rod ends are inserted into the adjacent ends of the female coupling 45, which is rotated in the direction shown by the white arrow, A. The threaded rod pins 39 and 40 and the female coupling 45 engage, and the rotation of the female coupling 45, as shown, draws the rods together, without causing either rod to rotate relative to one another. As they are drawn together, the dogs begin to engage, as seen in FIG. 11, and then completely engage, as shown in FIG. 12. Note that the female coupling 45 does not bear upon the shoulders 37 and 38. Shoulders 37 and 38 are present to protect the threads from being damaged by the wrenches and other equipment that engage with the wrench flats 35 and 36 during installation. FIG. 17 shows the made-up connection, with a cut-away in the coupling showing the fully engaged dog clutch members.

Once the dogs are engaged, the rods cannot rotate relative to one another, and the connection is secure. The only way it can come apart is if the female coupling 45 is unscrewed. Rotation of the rod string has no effect on the integrity of the coupling threaded connection with the rods, as the torque in the system is transmitted entirely via the dog clutch connection between the rods. The female coupling 45 has only to carry the tensional load of the rod weight. No particular amount of torque is required to make up this connection, as there is no required friction between components to transmit torque. Because of this, the components do not have to be particularly clean or dry during assembly.

Since the female coupling 45 need not be made up with appreciable torque, there may be circumstances where, through vibration or rubbing against the inner tubing wall, the female coupling 45 may begin to unscrew if not restrained somehow. To be completely sure that the female coupling 45 remains firmly made up with the threaded rod pins 39 and 40, one or both of the threaded rod pins 39 and 40 would be cut with a tapered thread so as to require some nominal torque to make up the connection between female coupling 45 and the threaded rod pins 39 and 40. This nominal torque would serve to keep the female coupling 45 from backing off in every circumstance. There are several other well known methods to lock threaded connections, and it is envisioned that any one or more of these alternative methods could be utilized in the present invention to prevent the female coupling 45 becoming inadvertently disconnected from the threaded rod pins 39 and 40.

Figure 18:
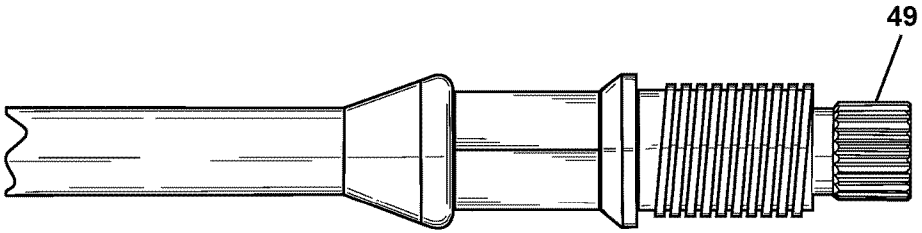
FIG. 18 and FIG. 19 show an alternative method to torsionally join the rod ends of the present invention, utilizing a spline connection rather than a dog clutch assembly.
Figure 19:
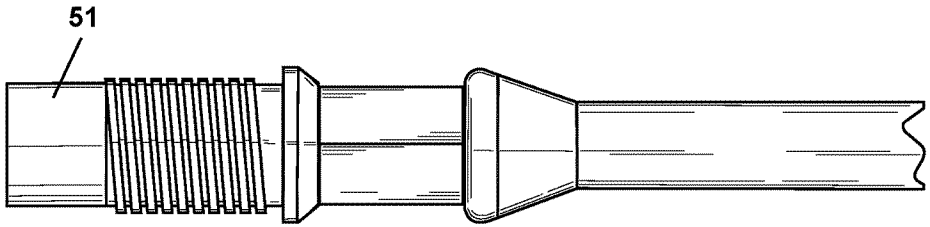
Figure 20:
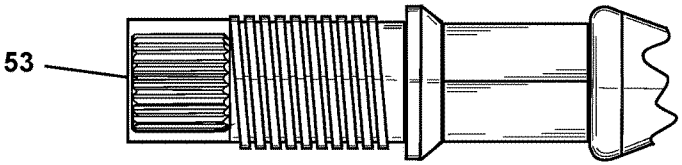
FIG. 20 shows a semi-transparent view of the end of the FIG. 19 rod, showing the female spline which mates with the male spline stub of FIG. 18.

Although the embodiment shown in FIGS. 7 through 17 is preferred, there are alternative ways to torsionally join the adjacent rods, while utilizing the same coupling concept of the preferred embodiment. FIGS. 18, 19 and 20 show such an alternative system consisting of a spline connection between the rods. A splined stub shaft 49, machined at the end of the FIG. 18 rod, mates with a female spline receptacle 51, machined at the end of the FIG. 19 rod. FIG. 20 shows, via a semi-transparent view, the internal female spline 53. This spline system would be more costly to manufacture, and not as strong as the preferred dog clutch system, but would function similarly.

It will be appreciated by those skilled in the art, upon reading this detailed description, may think of some other variations in structure and form to torsionally connect the adjacent rods, and such variations are within the contemplation of the invention as described and claimed in the following:

The invention claimed is:

1. A coupling system to axially connect a first rod to a second rod of a drive rod string, said first rod and said second rod each comprising a rod body and a coupling element, said coupling system comprising:

a cylindrical coupling having two sets of internal threads cut into an inner surface of said coupling, including a first female thread set having a right-hand cut and a second female thread set having a left-hand cut;

said coupling element of said first rod having a right-hand cut threaded pin disposed at an end of the first rod;

said coupling element of said second rod having a left-hand cut threaded pin disposed at an end of the second rod; and at least two dogs machined into the ends of each of the right-hand cut threaded pin of the first rod and the left-hand cut threaded pin of the second rod threaded pins, said at least two dogs of the first rod each configured to interlock with the at least two dogs of the second rod to torsionally connect the two rods when said at least two dogs are engaged;

wherein the diameter and pitch of the first female thread set and the second female thread set cut into the inner surface of said coupling match that of the right-hand cut threaded pin of the first rod and the left-hand cut threaded pin of the second rod, wherein said adjacent first and second rods being aligned axially with one another and with the cylindrical coupling, and wherein the direct torsional connection between the two dogs machined into the first ends of each of the right-hand cut threaded pin of the first rod and the left-hand cut threaded pin of the second rod is as strong as the torsional failure limit of the body of the first rod and of the second rod.

2. The coupling system of claim 1, wherein the friction generated between said coupling and the right-hand cut threaded pin of the first solid rod and the left-hand cut threaded pin of the second rod requires a predetermined amount of torque to rotate said coupling during the make-up of the coupling system.

3. The coupling system of claim 1, wherein one of the right-hand cut threaded pin of the first rod or the left-hand cut threaded pin of the second rod is cut with a tapered thread.

4. The coupling system of claim 1, wherein both of the right-hand cut threaded pin of the first rod or the left-hand cut threaded pin of the second rod are cut with a tapered thread.

5. The coupling system of claim 1, wherein the at least two dogs are clutch dogs.

6. The coupling system of claim 1, wherein one of the right-hand cut female thread set or left-hand cut female thread set on the inner surface of the cylindrical coupling is cut with a tapered thread.

7. The coupling system of claim 1, wherein both of the right-hand cut female thread set and left-hand cut female thread set on the inner surface of the cylindrical coupling are cut with a tapered thread.

8. The coupling system of claim 1, wherein a shoulder is disposed between the body of said first rod and the right-hand cut threaded pin.

9. The coupling system of claim 1, wherein a shoulder is disposed between the body of said second rod and the left-hand cut threaded pin.

10. The coupling system of claim 1, further comprising: at least one wrench flat disposed on each of the first and second rod bodies to be connected end to end.

11. The coupling system of claim 1, wherein an outer diameter of the two dogs is greater than the diameter of the body of the first rod and is greater than the diameter of the body of the second rod.

12. The coupling system of claim 1, wherein the first rod has a rod shoulder disposed between the rod body and the right-hand cut threaded pin and the second rod body has a rod shoulder disposed between the rod body and the left-hand cut threaded pin, and wherein upon interconnection of the first rod and the second rod via the cylindrical coupling, the rod shoulder of the first rod and the rod body of the second rod do not bear upon the cylindrical coupling.

13. The coupling system of claim 1, wherein upon engagement of the two dogs of the first rod and the second rod, the first rod and the second rod cannot rotate relative to one another.

14. The coupling system of claim 1, wherein the torsional force imposed on one of the rods is transmitted to the other rod entirely via the dog connection between the first rod and the second rod.

15. The coupling system of claim 1, wherein once the two dogs of each of the right-hand cut threaded pin of the first rod and the left-hand cut threaded pin of the second rod are engaged, the first rod and the second rod cannot rotate relative to one another.

16. The coupling system of claim 1, wherein the at least two dogs machined into the ends of each of the right-hand cut threaded pin of the first rod are two dogs, and wherein the at least two dogs machined into the left-hand cut threaded pin of the second rod threaded pins are two dogs.

17. The coupling wherein each dog is machined with a quarter circle cross-sectional shape and each rod has two dogs 180 degrees apart.

18. A drive-rod string comprising:

a first rod;

a right-hand cut threaded pin disposed at an end of the rod;

a left-hand cut threaded pin disposed at an end of the rod;

at least two dogs machined into the ends of the right-hand cut threaded pin and the left hand cut threaded pin, the at least two dogs interlockable with at least two dogs of a second rod to torsionally connect the rod with at least a second rod when the rod and the second rod are aligned axially end to end, wherein the direct torsional connection between the two dogs machined into the first ends of each of the right-hand cut threaded pin of the first rod and the left-hand cut threaded pin of the second rod is as strong as the torsional failure limit of the body of the first rod and of the second rod.

19. The rod of claim 18, wherein at least one wrench flat is disposed adjacent to at least one of the right-hand cut threaded pin and the left-hand cut threaded pin.

20. The rod of claim 18, wherein a shoulder is disposed adjacent to one or more of the at least one of the right-hand cut threaded pin and the left-hand cut threaded pin.

* * * * *